US006160225A

United States Patent [19]

Isikawa

[11] Patent Number: 6,160,225

[45] Date of Patent: Dec. 12, 2000

[54] MULTIDIRECTIONAL INPUTTING APPARATUS

[75] Inventor: Sinzi Isikawa, Miyagi-ken, Japan

[73] Assignee: Alp Electric Co., Ltd., Tokyo, Japan

[21] Appl. No.: 09/097,894

[22] Filed: Jun. 16, 1998

[30] Foreign Application Priority Data

Jul. 3, 1997 [JP] Japan ..... 9-178324

[51] Int. Cl.[7] ..... H01H 3/46

[52] U.S. Cl. ..... 200/4; 200/6 A; 200/7

[58] Field of Search ..... 200/4, 54, 5 R, 200/6 A, 6 R, 16 R, 1 B, 16 A–16 C, 7, 18; 273/148 B

[56] References Cited

U.S. PATENT DOCUMENTS

| | | | |
|---|---|---|---|
| 4,245,137 | 1/1981 | Hirai et al. | 200/4 |
| 4,616,115 | 10/1986 | Potyka | 200/6 A X |
| 5,459,292 | 10/1995 | Nagano et al. | 200/5 R |
| 5,665,946 | 9/1997 | Nishijima et al. | 200/4 |
| 5,847,335 | 12/1998 | Sugahara et al. | 200/4 |

FOREIGN PATENT DOCUMENTS 07235241 9/1995 Japan .

*Primary Examiner*—Renee Luebke

*Attorney, Agent, or Firm*—Brinks Hofer Gilson & Lione

[57] ABSTRACT

Disclosed is a multidirectional inputting apparatus which can provide a positive switching operation and which is suitable for a reduction in size. In the multidirectional inputting apparatus, a first fixed contact and a common contact are provided on the inner bottom surface of a housing, and a first movable contact plate placed on the common contact and the first fixed contact form an second switch. An operating lever is tiltably held in the housing, and the operating lever is spline-coupled to a driver onto which a second movable contact plate is fixed. A cover is placed on an upper open end of the housing, and a plurality of fixed contacts are arranged on the bottom surface of the cover in the circumferential direction at predetermined intervals. A conductive coil spring is provided between the common contact and the second movable contact plate. The second movable contact plate is pressed into contact with the second fixed contacts by a biasing force of the coil spring, whereby a plurality of first switches are formed by the respective second fixed contacts and the second movable contact plate.

5 Claims, 5 Drawing Sheets

MULTIDIRECTIONAL INPUTTING APPARATUS

BACKGROUND OF THE INVENTION

1. Field of the Invention

The present invention relates to a multidirectional inputting apparatus capable of operating a switch in response to a tilting direction of an operating lever.

2. Description of the Related Art

Hitherto, as disclosed in Japanese Unexamined Patent Publication No. 7-235241, a multidirectional inputting apparatus has been proposed. Such a conventional multidirectional inputting apparatus is mainly composed of a housing of which the top surface is opened, a cover placed on the opening end of the housing, a switch element provided inside the housing, and an operating lever for operating the switch element. The switch element is composed of one central fixed contact provided on the inner bottom surface of the housing, a plurality of peripheral fixed contacts and common contacts, and a movable contact plate placed on the inner bottom surface of the housing. The movable contact plate is always in contact with the common contacts, but the central fixed contact is separated from the peripheral fixed points. The operating lever is tiltably held inside the housing, and the upper portion thereof is projected outside through the cover. This operating lever is provided with a flange, and the flange has a plurality of support points opposing the lower surface of the cover and elastic portions located outside of respective support points formed thereon.

In the thus constructed conventional multidirectional inputting apparatus, when the operating lever is in the neutral position, the movable contact plate is separated from the central fixed contact and the peripheral fixed points, so that a switch-OFF state can be obtained. On the other hand, when the operating lever is tilted in an arbitrary direction, the operating lever is tilted using the support points located in the opposite side of the tilting direction as fulcrums, so that elastic portions located in the tilting direction press the periphery of the movable contact plate, and the lower end of the operating lever presses the center of the movable contact plate. This allows the peripheral fixed contacts and the central fixed contact to be electrically connected through the movable contact plate, thereby obtaining a switch-ON state.

Therefore, although the movable contact plate is not in contact with the central fixed point, the elastic portions cause further flexing when the operating lever is tilted in an arbitrary direction and the movable contact plate comes into contact with the peripheral fixed contacts, thereby bringing the movable contact plate into contact with the central fixed contact.

The above conventional multidirectional inputting apparatus encounters the following problems.

The apparatus is constructed so that the elastic portions formed on the operating lever bring the movable contact plate into contact with the peripheral fixed contacts. Therefore, contact pressure of the movable contact plate to the peripheral fixed contacts cannot be increased, resulting in poor electrical connection.

Since one central fixed contact and a plurality of peripheral fixed contacts surrounding the central fixed contact are required to be provided on the inner bottom surface of the housing, the width of the housing is increased according to a space for arranging thereon these fixed contacts, so that a reduction in size of the apparatus is prevented.

SUMMARY OF THE INVENTION

Accordingly, it is an object of the present invention to provide a multidirectional inputting apparatus which can provide a positive switching operation and which is suitable for a reduction in size.

According to an aspect of the present invention, there is provided a multidirectional inputting apparatus, including: an upper member and a lower member combined in one piece through a storage space; an operating lever tiltably held inside the storage space and projecting outside through the upper member; a first fixed contact provided on the lower member; a first movable contact plate opposing the first fixed contact; second fixed contacts provided on the circumference of the upper member at predetermined intervals; a second movable contact plate opposing the second fixed contacts; and a biasing member for pressing the second movable contact plate into contact with the second fixed contacts, wherein the first movable contact plate comes into contact with the first fixed contact when the operating lever is tilted, and the second movable contact plate uses one or two of the second fixed contacts as a tilting fulcrum so as to be separated from the rest of the second fixed contacts.

With the above arrangements, the first movable contact plate and the first fixed contact are positively brought into contact with and separated from each other, and the second movable contact plate and the second fixed contacts are positively brought into contact and separated from each other, so that poor electrical connection can be prevented. In addition, the first fixed contact and the second fixed contacts can be divided into separate members, so that a reduction in size of the apparatus can be achieved.

In the multidirectional inputting apparatus, a conductive coil spring may be used as the biasing member, and one end of the coil spring may be brought into contact with a common contact provided on the lower member and the other end may be brought into contact with the second movable contact plate. With this arrangement, a conductive path for always connecting the first movable contact plate and the second movable contact plate through the coil spring is formed. Therefore, the overall structure of the apparatus can be simplified.

In addition, the first movable contact plate may be provided between the lower end of the operating lever and the lower member, and the second movable contact plate may be fixed to a driver loosely fitted to the operating lever. With this arrangement, a force of the biasing member does not act on the operating lever when the operating lever is pushed. Therefore, the operating lever can be pushed with a light force.

Further, one of the upper member and the lower member may be provided with a stopper for controlling the amount of tilt of the second movable contact plate. With this arrangement, an excessive pressing force from the operating lever does not act on the first movable contact plate. Therefore, the first movable contact plate can be prevented from being damaged.

Still further, an elastic member may be provided between the lower end of the operating lever and the first movable contact plate. With this arrangement, the elastic member is further compressed by the lower end of the operating lever even after the first fixed contact has been brought into contact with the first movable contact plate. Therefore, an over-stroking in the tilting direction can be imparted to the operating lever.

DESCRIPTION OF THE PREFERRED EMBODIMENT

An embodiment of a multidirectional inputting apparatus according to the present invention will now be described with reference to FIGS. 1 to 9.

Figure 6:
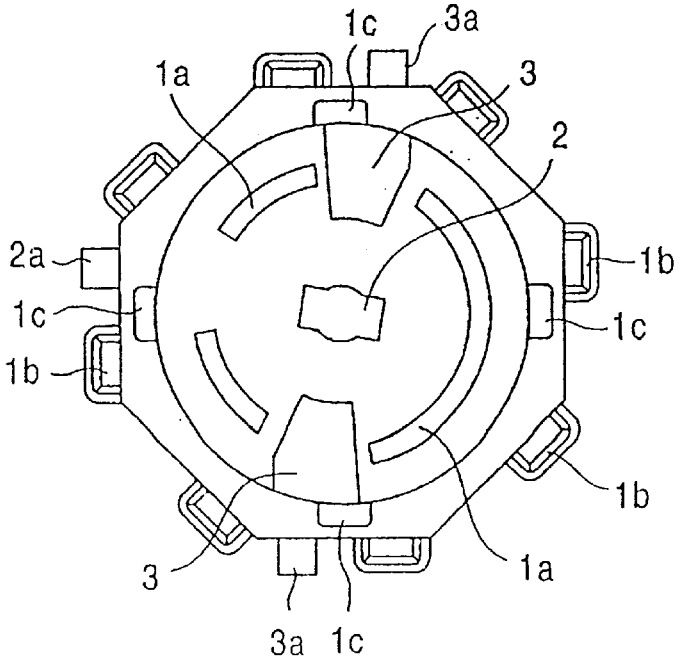
FIG. 6 is a plan view of a housing.
Figure 7:
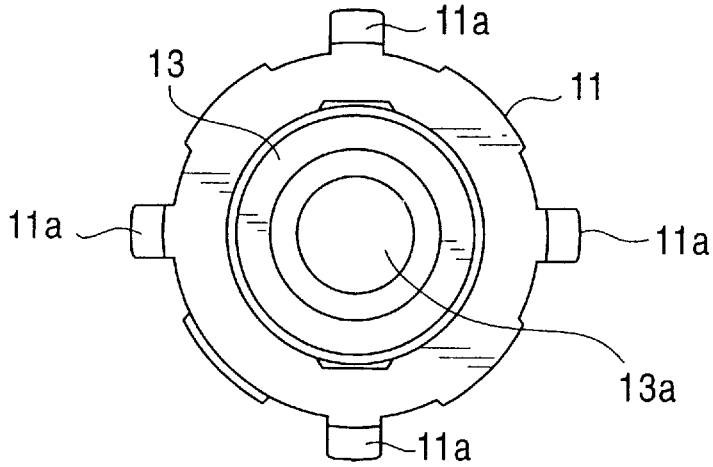
FIG. 7 is a plan view showing a driver and a second movable contact plate.
Figure 8:
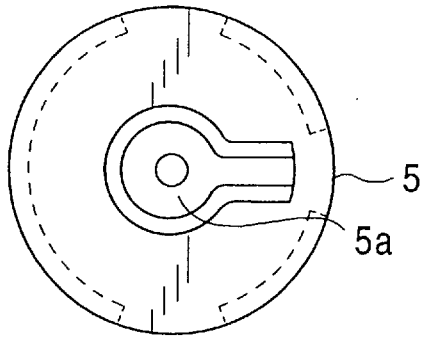
FIG. 8 is a plan view of a guide member.

Referring to the drawings, a housing 1 made of synthetic resin forms a lower member. The housing 1 is octagonal in plan view of which the top surface is opened. As shown in FIG. 6, a first fixed contact 2 is disposed in the center of the inner bottom surface of the housing 1, and two common contacts 3 are provided on the periphery of the inner bottom surface of the housing 1. The first fixed contact 2 and the common contacts 3 are drawn out of the housing 1 as a terminal 2*a* and terminals 3*a*, respectively. A plurality of projections 1*a* are disposed on the inner bottom surface of the housing 1. These projections 1*a* are arranged on the same circular arc around the first fixed contact 2. Guide slots 1*b* are formed in the outer walls of each side of the housing 1, and four stopper cutouts 1*c* are formed on the side of the open end of the inner wall of the housing 1 at angular intervals of 90°.

A dome-shaped first movable contact plate 4 is placed on the inner bottom surface of the housing 1, and the position of the outer periphery thereof is controlled by the projections 1*a*. The first movable contact plate 4 is always in contact with the common contacts 3, but is separated from the first fixed contact 2. The first fixed contact 2 and the first movable contact plate 4 constitute a second switch S1. In addition, the position of a guide member 5 made of synthetic resin is defined by the projections 1*a*, and a pressing piece 5*a* is integrally formed with the guide member 5 in a cantilevered form (see FIG. 8). A cylindrical rubber elastic member 6 is mounted on the top surface of the pressing piece 5*a*, and the lower end of the pressing piece 5*a* opposes the center of the top surface of the first movable contact plate 4.

Figure 9:
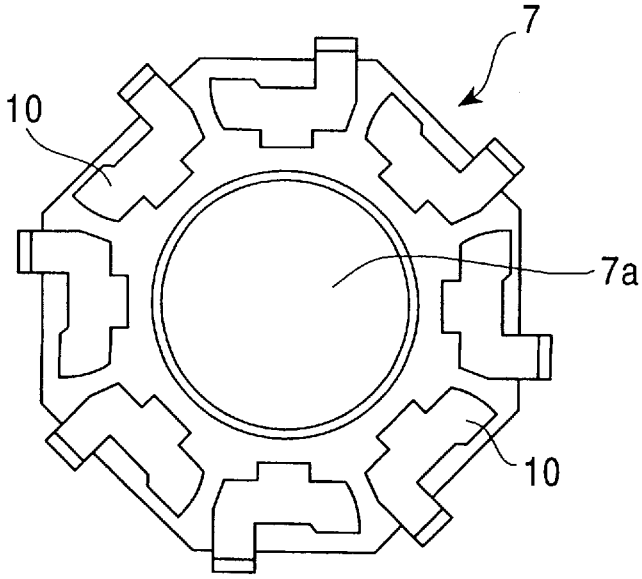
FIG. 9 is a bottom view of a cover.

An open end of the housing 1 is covered with a cover 7 made of synthetic resin which forms an upper member, and a storage space 8 is defined between the housing 1 and the cover 7. Second fixed contacts 10 are molder and connected to the lower surface of the cover 7. A metal plate having a mounting foot 9 is placed on the top surface of the cover 7, and by extending downward the mounting foot 9 along the outer wall of the housing 1 and by bending inward the tip of the foot 9 at a right angle, the housing 1 and the cover 7 are combined in one piece. As shown in FIG. 9, a through hole 7*a* is formed in the center of the cover 7, and eight second fixed contacts 10 are disposed around the through hole 7*a* at predetermined intervals. These second fixed contacts 10 extend downward as terminals 10*a*, and these terminals 10*a* are thrust into the guide slots 1*b* of the housing 1, respectively.

A second movable contact plate 11 is placed inside the storage space 8, and an electrically conductive coil spring 12 is provided between the second movable contact plate 11 and the inner bottom surface of the housing 1. The lower end of the coil spring 12 is in contact with the common contacts 3, and the common contacts 3 and the second movable contact plate 11 are always electrically connected through the coil spring 12. The second movable contact plate 11 is pressed into contact with the second fixed contacts 10 provided on the lower surface of the cover 7 by a biasing force of the coil spring 12, and eight first switch S2 are formed by these second fixed contacts 10 and the second movable contact 11. The second movable contact plate 11 is molded and connected to a driver 13 which is made of synthetic resin, and the upper portion of the driver 13 is engaged with the through hole 7*a* of the cover 7. Four projections 11*a* are formed on the outer periphery of the second movable contact plate 11 at angular intervals of 90° (see FIG. 7), and these projections 11*a* are inserted into cutouts 1*c* formed in the inner wall of the housing 1 so as not to be rotatable in the direction of rotation. A center hole 13*a* having an oval-shaped lower portion is formed in the driver 13 into which a metal operating lever 14 is inserted. The operating lever 14 can move in the axial direction with respect to the center hole 13*a*. However, the operating lever 14 is spline-coupled to the oval-shaped portion of the center hole 13*a*, whereby the movement thereof in the direction of rotation is restricted. The upper portion of the operating lever 14 is projected outside the cover 7, and the lower end thereof is in abutment with the rubber elastic member 6.

The operation of the thus constructed multidirectional inputting apparatus will now be described.

Figure 1:
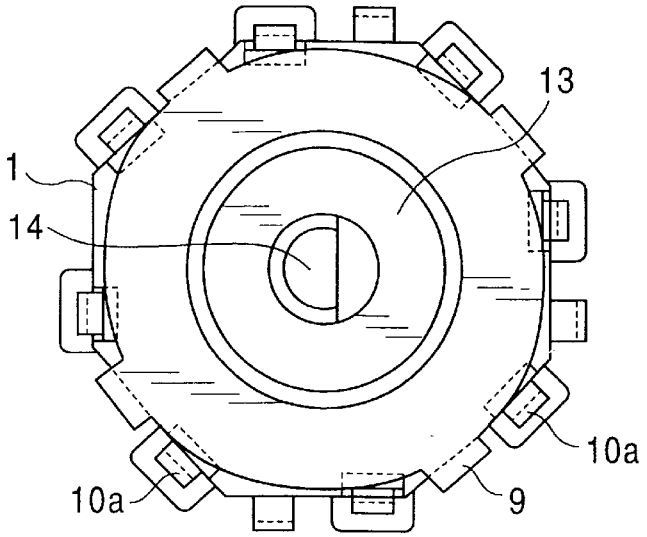
FIG. 1 is a plan view of a multidirectional inputting apparatus according to an embodiment of the present invention.
Figure 2:
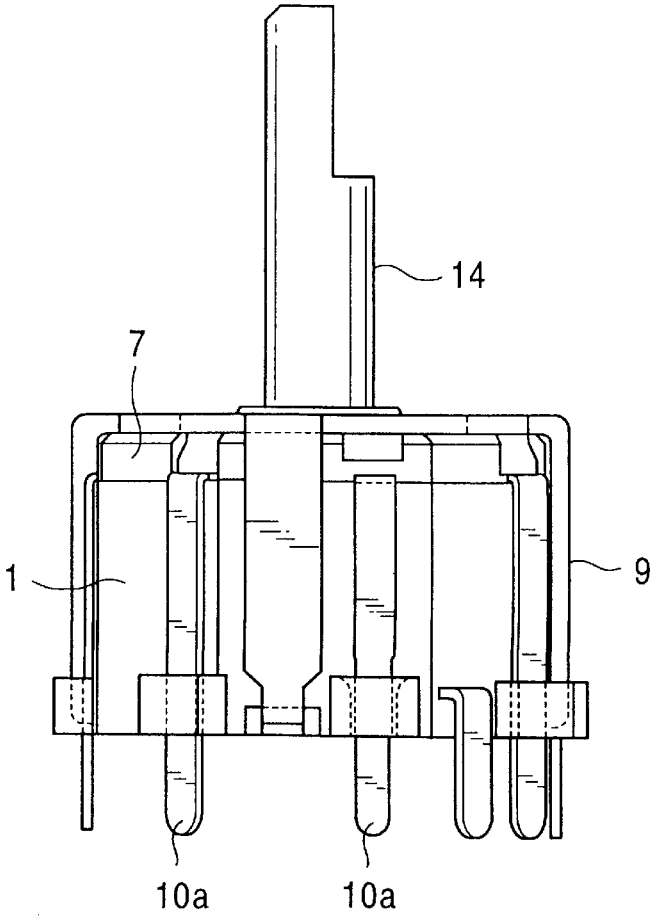
FIG. 2 is a front view of the multidirectional inputting apparatus.
Figure 3:
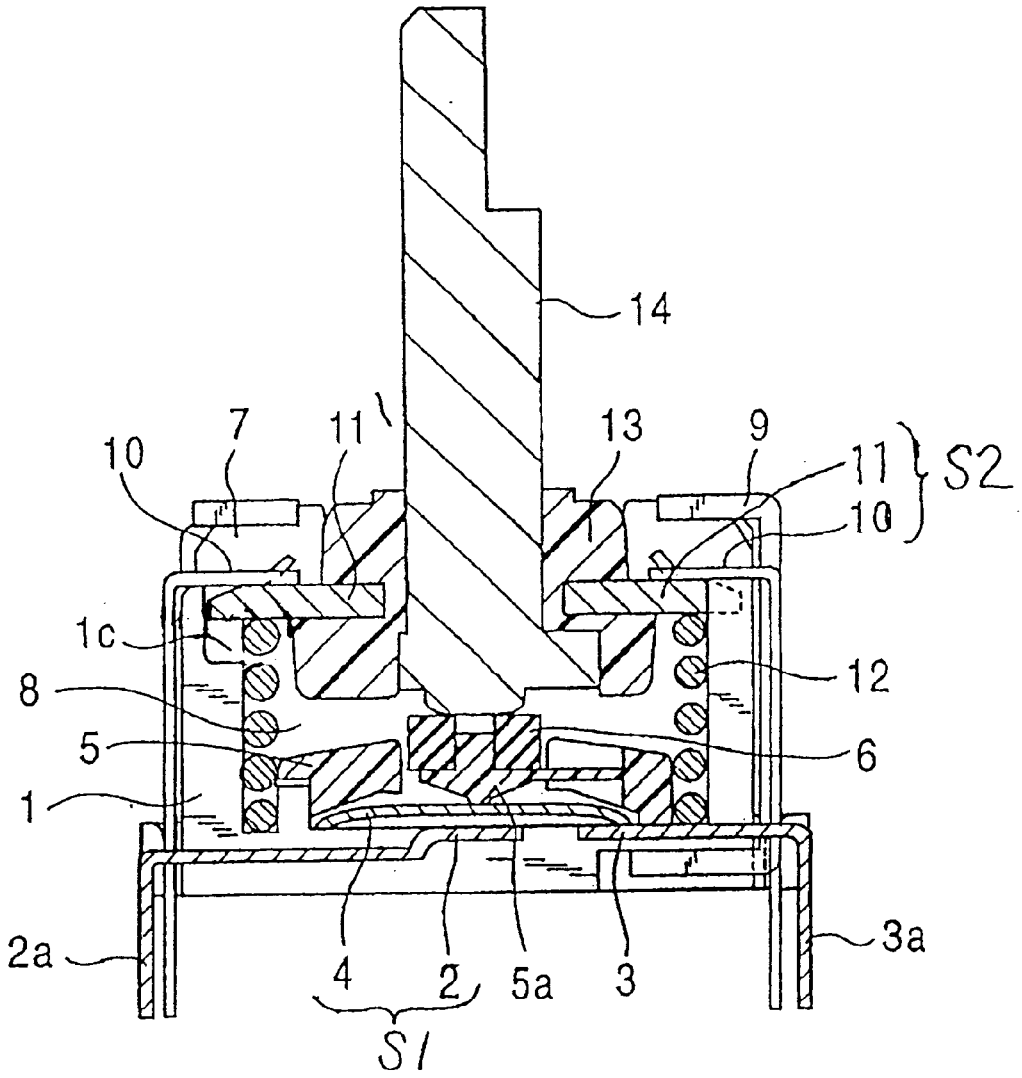
FIG. 3 is a cross-sectional view showing a non-operated state of the multidirectional inputting apparatus.

When the operating lever 14 is in the neutral position shown in FIG. 3, the first movable contact plate 4 is separated from the first fixed contact 2, so that the second switch S1 is in the OFF state. In addition, the second movable contact plate 11 is in contact with all the fixed contacts 10, so that the eight first switches S2 are in the ON state.

Figure 4:
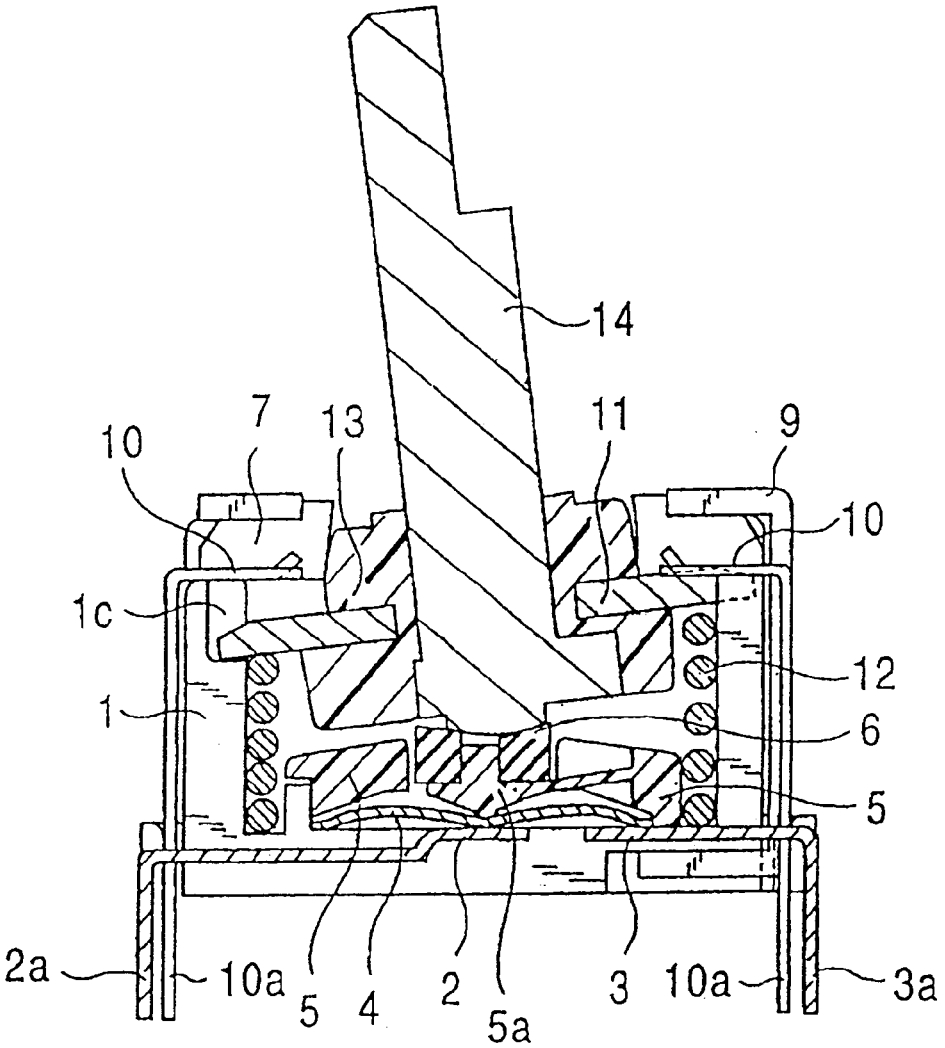
FIG. 4 is a cross-sectional view showing a tilting operation of the multidirectional inputting apparatus.
Figure 5:
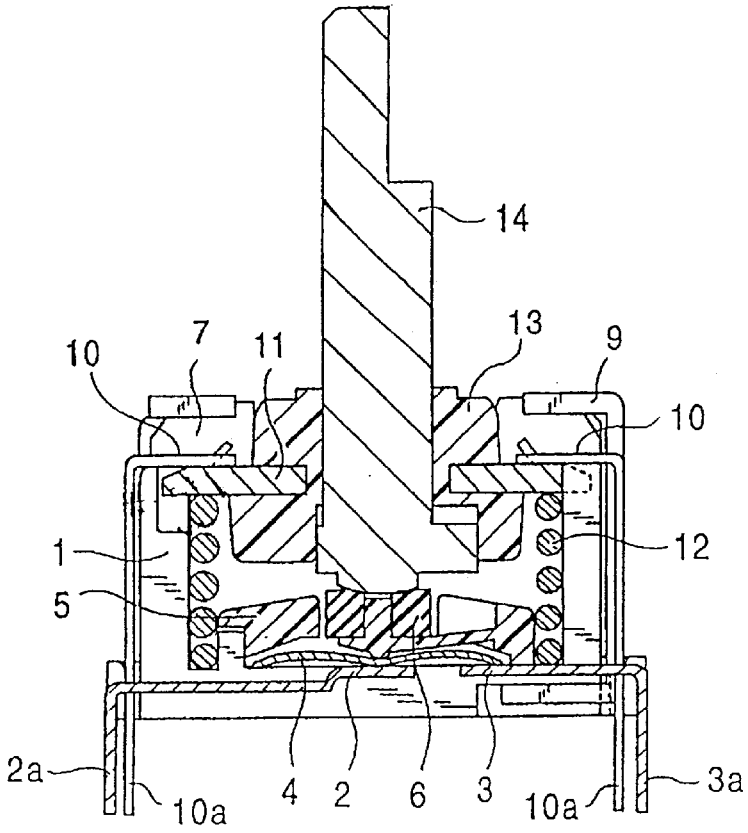
FIG. 5 is a cross-sectional view showing a pushing operation of the multidirectional inputting apparatus.

If the operating lever 14 is tilted in an arbitrary direction, for example, in the direction shown in FIG. 4, the second movable contact plate 11 is rotated using the second fixed contact 10 located on the opposite side of the tilting direction as a fulcrum, and is separated from other second fixed contacts 10, so that other first switches S2 are changed to the OFF state while maintaining the ON state of the first switch S2 corresponding to the second fixed contact 10 used as the fulcrum. With the tilting operation of the operating lever 14, the lower end of the operating lever 14 presses the first movable contact plate 4 through the rubber elastic member 6 and the pressing piece 5*a*, so that the second switch S1 is switched to the ON state when the first movable contact plate comes into contact with the first fixed contact 2. After the second switch S1 is switched to the ON state, the operating lever 14 can be further tilted until the projections 11*a* of the second movable contact plate 11 come into abutment with the bottom ends of the cutouts 1*c*, and the amount of over-stroking of the operating lever 14 during the tilting is absorbed by a compressive deformation of the rubber elastic member 6. When a tilting force to the operating lever 14 is removed, the second movable contact plate 11 returns to its original state as a result of a biasing force of the coil spring 12, so that the operating lever 14 returns to the neutral position shown in FIG. 3 and all eight of the first switches S2 are changed to the ON state again. In addition, the rubber elastic member 6, the pressing piece 5*a* and the first movable contact plate 4 are restored as a result of their own elasticity and the first movable contact plate 4 is separated from the first fixed point 2, so that the second switch S1 is changed to the OFF state again. The same is true for a case where the operating lever 14 is tilted in a direction different from the direction shown in FIG. 4.

On the other hand, if the operating lever 14 is pressed from the neutral position shown in FIG. 3, the operating lever 14 moves directly downward by being guided by the center hole 13*a* of the driver 13 so as to press the first movable contact plate 4 through the rubber elastic member 6 and the pressing piece 5*a*. In this case, since the second movable contact plate 11 and the driver 13 do not move, all eight of the first switches S2 maintain the ON state, and the second switch S1 is changed from the OFF state to the ON state when the first movable contact plate 4 comes into contact with the first fixed contact 2. When a pressing force to the operating lever 14 is removed, the rubber elastic member 6, the pressing piece 5*a* and the first movable contact plate 4 are restored as a result of their own elasticity and the first movable contact plate 4 is separated from the first fixed contact 2, so that the second switch S1 is changed to the OFF state again.

In the thus constructed multidirectional inputting apparatus, if a terminal 2*a* of the first fixed contact 2 and terminals 10*a* of the second fixed contacts 10 are connected to a microcomputer, the microcomputer can detect the tilting direction and pushing operation of the operating lever 14 based on ON/OFF signals between the terminal 2*a* and the terminals 10*a*. That is, when the operating lever 14 is in the neutral position, all eight of the first switches S2 are in the ON state but the second switch S1 is in the OFF state, so that the microcomputer takes in OFF signals from the terminal 2*a* and the terminals 10*a*, and judges that the operating lever 14 is in a non-operated state. In addition, when the operating lever 14 is tilted in an arbitrary direction, the second switch S1 and one of the first switch S2 are changed to the ON state, so that a conducting path including the first fixed contact 2, the first movable contact plate 4, the common contact 3, the coil spring 12, the second movable contact plate 11 and the second fixed contact 10 is formed, which is shown cross-hatched in FIG. 4. On the basis of the ON signals output from the conducting path, the microcomputer judges that the operating lever 14 is tilted in the direction opposite to the second fixed contact 10 which is in the ON state. Further, when the operating lever 14 is pressed in the neutral position, the second switch S1 is in the ON state while all eight of the first switches S2 are held in the ON state, so that the microcomputer takes in the ON signals from all of the terminal 2*a* and the terminals 10*a*, and judges that the operating lever 14 is pushed.

The terminal 2*a* of the first fixed contact 2, terminals 3*a* of the common contacts 3 and the terminals 10*a* of the second fixed contacts 10 may be connected to the microcomputer. In this case, the microcomputer monitors the ON/OFF states of the first switches S1, and judges that the operating lever 14 is in the non-operated state when the terminals 2*a* and 3*a* are in the OFF state. When the microcomputer takes in ON signals from the terminals 2*a* and 3*a*, the microcomputer monitors the ON/OFF states of the first switches S2 using the ON signals as a trigger. When the terminals 3*a* and all the eight terminals 10*a* are in the ON state, the microcomputer judges that the operating lever 14 is pushed. When the ON signals are output between the terminals 3*a* and a specific terminal 10*a*, the microcomputer determines the tilting direction of the operating lever 14 based on the ON signals.

When the operating lever 14 is tilted toward the center of two adjacent second fixed contacts 10, the second movable contact plate 11 might cause a slight flexing so as to be rotated using the two second fixed contacts 10 located on the opposite side of the tilting direction as fulcrums and to be separated from the other second fixed contacts 10. In this case, therefore, two of the eight first switches S2 are in the ON state, and the other first switches S2 are in the OFF state. If the microcomputer is constructed so as to determine the order of preference of the eight first switches S2, an insensitive zone where the switching operation is not effected can be eliminated.

The number of second fixed contacts is not limited to eight. For example, if four second fixed contacts 10 are provided at angular intervals of 90°, a multidirectional inputting apparatus detecting four directions can be realized.

What is claimed is:

1. A multidirectional inputting apparatus, comprising:

an upper member and a lower member combined to form a storage space;

an operating lever tiltably held inside said storage space and projecting outside through said upper member;

a first fixed contact provided on said lower member;

a first movable contact plate opposing said first fixed contact;

at least three second fixed contacts provided on said upper member and circumferentially spaced about said operating lever at predetermined intervals;

a second movable contact plate opposing said second fixed contacts; and a biasing member for pressing said second movable contact plate into contact with said second fixed contacts, wherein said first movable contact plate comes into contact with said first fixed contact and said second movable contact plate comes into contact with at least one but no more than two of the second fixed contacts and leaving a remaining number of second fixed contacts not contacted by said second movable contact plate when said operating lever is tilted, said second fixed contacts in contact with said second movable contact plate serving as a tilting fulcrum so as to separate said second movable contact plate from said remaining number of second fixed contacts not contacted by said second movable contact plate.

2. A multidirectional inputting apparatus according to claim 1, wherein said biasing member is formed of a conductive coil spring having a first end and a second end, and said first end of the coil spring is in contact with a common contact provided on said lower member and said second end is in contact with said second movable contact plate.

3. A multidirectional inputting apparatus according to claim 1, wherein said first movable contact plate is provided between a lower end of said operating lever and said lower member, and said second movable contact plate is fixed to a driver loosely fitted to said operating lever.

4. A multidirectional inputting apparatus according to claim 3, wherein said second movable contact plate is tiltable through an angle and one of said upper member and said lower member is provided with a stopper for limiting the angle of tilt of said second movable contact plate.

5. A multidirectional inputting apparatus according to claim 4, wherein an elastic member is provided between the lower end of said operating lever and said first movable contact plate.

* * * * *

UNITED STATES PATENT AND TRADEMARK OFFICE

CERTIFICATE OF CORRECTION

PATENT NO. : 6,160,225
DATED : December 12, 2000
INVENTOR(S) : Sinzi Isikawa

It is certified that error appears in the above-identified patent and that said Letters Patent is hereby corrected as shown below:

Title page,
Item [73], please delete "Alp Electric Co., Ltd." and substitute -- Alps Electric Co., Ltd. -- in its place.

Signed and Sealed this

Seventh Day of May, 2002

*Attest:*

*Attesting Officer*

JAMES E. ROGAN
*Director of the United States Patent and Trademark Office*